US006065515A

United States Patent [19]

Harris

[11] Patent Number: 6,065,515

[45] Date of Patent: May 23, 2000

[54] MONEY HOLDERS

[75] Inventor: William R. Harris, San Antonio, Tex.

[73] Assignee: Hidea Innovative Products, L.C., San Antonio, Tex.

[21] Appl. No.: 09/154,757

[22] Filed: Sep. 17, 1998

[51] Int. Cl.[7] ..... A45C 1/06

[52] U.S. Cl. ..... 150/132; 150/145; 150/146; 150/147

[58] Field of Search ..... 150/131, 132, 150/140, 141, 145, 147, 146

[56] References Cited

U.S. PATENT DOCUMENTS

| | | | |
|---|---|---|---|
| Re. 17,327 | 6/1929 | Halvorsen et al. | 150/145 X |
| 658,394 | 9/1900 | Peters | 150/139 X |
| 779,742 | 1/1905 | Schultz | 150/132 |
| 906,596 | 12/1908 | Wilson | 150/134 X |
| 940,853 | 11/1909 | Cardwell | 150/132 |
| 1,035,945 | 8/1912 | Cardwell | 150/132 |
| 1,228,251 | 5/1917 | Smith | 150/132 |
| 1,545,577 | 7/1925 | Arms | 150/147 |
| 1,645,709 | 10/1927 | Lorber | 150/132 X |
| 1,749,020 | 3/1930 | Curry | 150/145 X |
| 1,765,730 | 6/1930 | L'Enfant | 150/140 |
| 1,772,891 | 8/1930 | Gardner, Jr. | 150/132 |
| 1,807,482 | 5/1931 | Kurtz, Jr. | 160/140 X |
| 2,078,935 | 5/1937 | Downes | 150/132 |
| 2,249,558 | 7/1941 | Green | 150/145 X |
| 2,397,366 | 3/1946 | Ogden | 150/140 |
| 2,654,409 | 10/1953 | Cox | 150/132 X |
| 2,955,633 | 10/1960 | Seitz | 150/132 |
| 3,147,789 | 9/1964 | Paulson | 150/145 X |
| 4,105,057 | 8/1978 | Baumann et al. | 150/147 X |
| 4,153,275 | 5/1979 | Phillips | 150/146 X |
| 4,209,048 | 6/1980 | Sandos | 150/132 |
| 4,890,728 | 1/1990 | Grimsley | 150/147 X |
| 4,942,913 | 7/1990 | Musso | 150/145 X |
| 4,945,961 | 8/1990 | Healy | 150/132 |
| 5,257,656 | 11/1993 | McLeroy | 150/132 |

FOREIGN PATENT DOCUMENTS

| | | | |
|---|---|---|---|
| 578820 | 10/1924 | France | 150/131 |
| 1036997 | 9/1953 | France | 150/147 |
| 1459254 | 10/1966 | France | 150/147 |
| 133276 | 10/1919 | United Kingdom | 150/131 |
| 994593 | 6/1965 | United Kingdom | 150/132 |

*Primary Examiner*—Sue A. Weaver
*Attorney, Agent, or Firm*—Jackson Walker L.L.P.

[57] ABSTRACT

A single-fold money or bill holder has a generally rectangular single sheet of backing material and a first cover flap attached to and overlaying more than one-half the length and less than the full length of the backing sheet. Further, the first cover flap overlies more than one-half but less than the fill width of the backing sheet. The cover flap is aligned along two edges with two edges of the backing sheet and attached along at least one edge. Numerous embodiments include pockets, credit card compartments with transverse slits, and transparent pocket faces.

17 Claims, 3 Drawing Sheets

MONEY HOLDERS

BACKGROUND OF THE INVENTION

The present invention relates to a money holder or billfold or bill holder. More particularly, the present invention is a multi-flap single-fold billfold which may incorporate various seams, pockets, and windows to provide for improved display of the items stored or placed therein.

DETAILED DESCRIPTION OF THE PREFERRED EMBODIMENT

Figure 1:
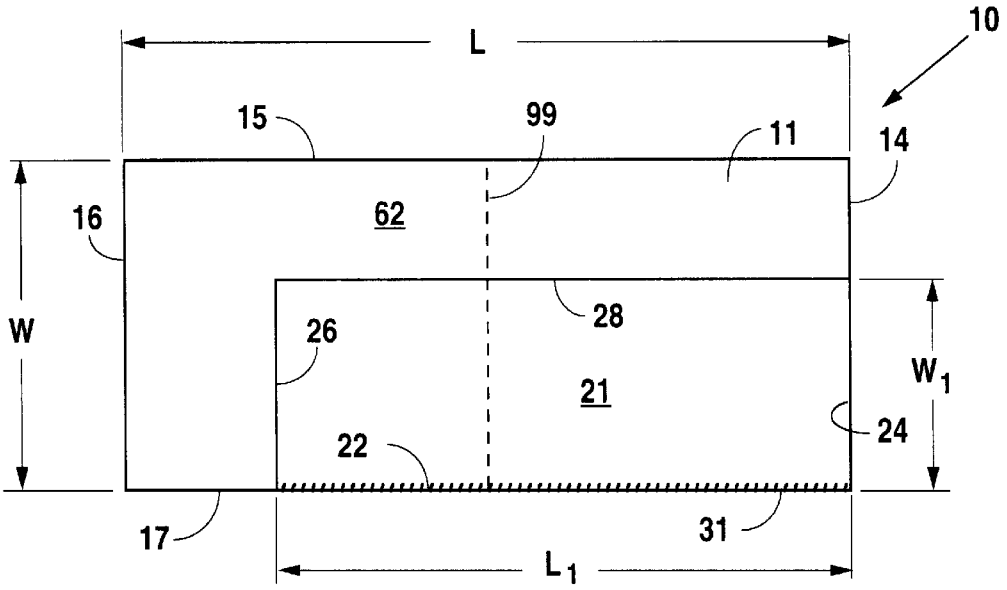
FIG. 1 illustrates the present invention in a right-handed open configuration.

FIG. 1 illustrates a first embodiment of the money holder 10 in the open position for a right-handed person. A sheet of backing material 11 prevents onlookers from viewing what currency is contained in the billfold 10, while first cover 21 is designed to hold currency in a position that allows the person using the money holder 10 to view such currency and supports the currency from folding over upon itself Sheet 11 may be any type of fabric, leather, or even stiff paper material. Flap 21 is smaller than standard size currency, and is held against backing sheet 11 by a seam 31 along the lower edge of the backing sheet 11. Because flap 21 leaves the top and one side of the currency uncovered, the person carrying the money holder can easily view the currency denominations held therein. While FIG. 1 shows an embodiment of the money holder for a right-handed person it may be modified in several ways as described below.

It should be understood that backing sheet 11 is generally rectangular in shape and has four outer edges 14, 15, 16, and 17. The length L and the width W of the backing sheet 11 is fixed and is normally slightly larger than the size of the largest paper currency in use by the user. As may be seen in the figures, the first cover flap 21 extends and overlays the backing sheet 11 by more than one-half the length L of the backing sheet, but less than the full length of the backing sheet. Similarly, the flap 21 extends and overlays more than one-half the width W of the backing sheet 11, but less than the full width of the backing sheet. A preferable range of overlap of the flap 21 upon backing sheet 11 is 65%–85% of both the full length L and the full width W. Although not drawn to scale the figures are intended to illustrate an approximate 78% overlap in both directions. The size relationship of the flap 21 to the backing sheet is important to ensure that currency placed between the flap 21 and the backing sheet 11 is supported sufficiently to not fold over upon itself when the billfold 10 is in the open position shown in FIG. 1.

Further, it has been found that the back side of the fold line 99 formed in the cover flap 21 (best seen in FIGS. 7–9) further urges against the currency to hold the currency in between the backing sheet 11 and the first cover flap 21. The billfold 10 may even be inverted and the currency will not fall out.

First cover flap 21 has four outer edges 22, 24, 26, and 28. Two of the outer edges 22 and 24 are aligned with and overlay edges 14 and 17 of the backing sheet 11. Flap 21 is affixed to the backing sheet 11 at edges 17 and 22. While stitching may be used to vary the aesthetic aspects of the device, other generally known fasteners may be used.

Figure 2:
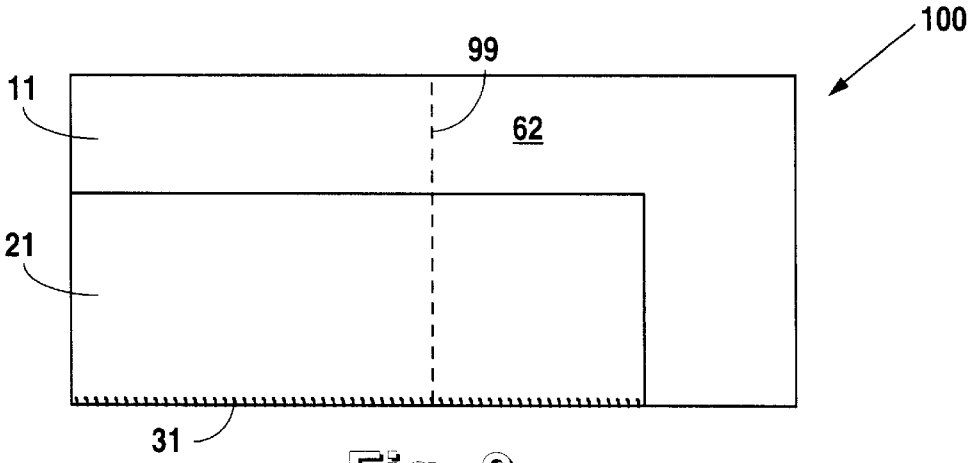
FIG. 2 illustrates the present invention in a left-handed open configuration.

FIG. 2 is an embodiment of the money holder 100 for a left-handed person, again with first cover flap 21 overlaying backing sheet 11 and attached along a seam 31. The feature of the left-handed embodiment 100 are the same as those discussed above for the right-handed embodiment 10.

Figure 3:
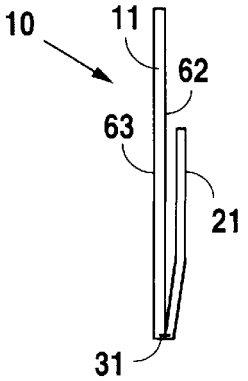
FIG. 3 illustrates a side elevation view of the present invention.

FIG. 3 is a side elevation view showing the billfold 10, backing sheet 11, first cover flap 21, and seam 31. It may be seen that flap 21 is only attached to backing sheet 11 along one edge.

Figure 4:
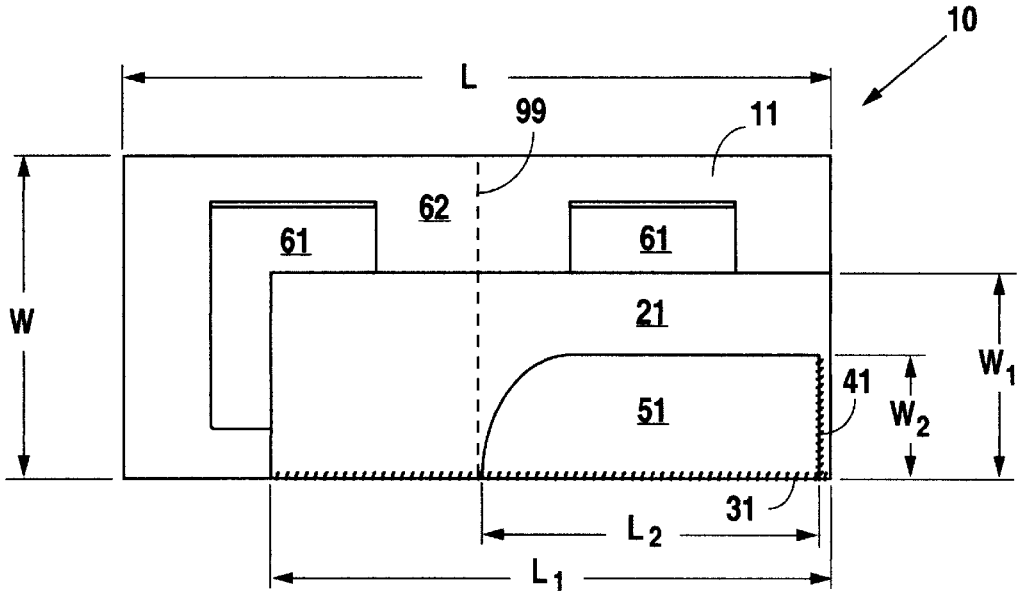
FIG. 4 illustrates the present invention in a right-handed configuration with a second cover flap.
Figure 5:
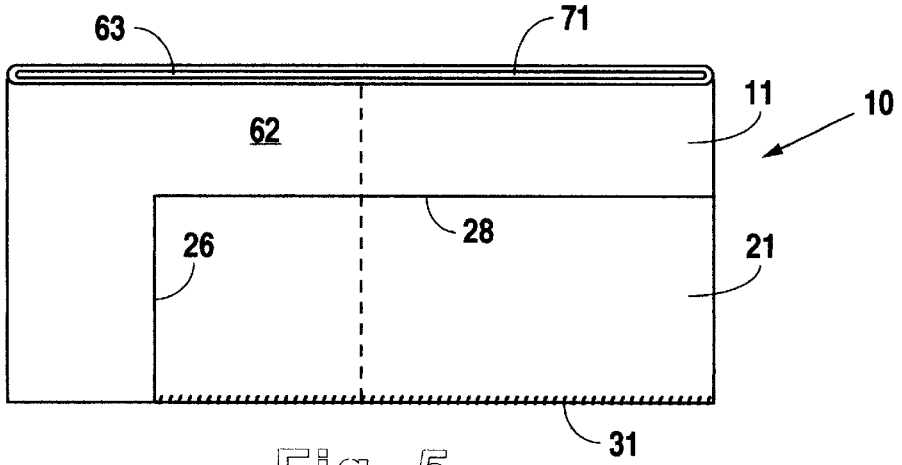
FIG. 5 illustrates the present invention in a right-handed configuration with top pocket.
Figure 6:
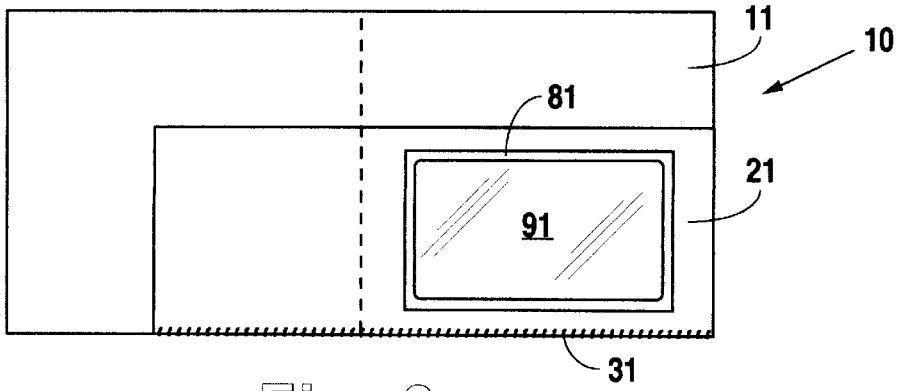
FIG. 6 illustrates the present invention in a right-handed configuration with a pocket having a transparent window for identification cards.

In FIGS. 4, 5, and 6, various pockets and flaps are exemplified providing other embodiments of the invention. As illustrated in FIG. 4, a second flap 51 has been added, as well as inside pockets 61. Second flap 51 is shown attached to first flap 21 at seams 31 and 41. Only seam 31 extends through first flap 21 and second flap 51 and backing sheet 11. Seam 41 extends through the second cover flap 51 to the first cover flap 21, but not the backing sheet 11.

Figure 9:
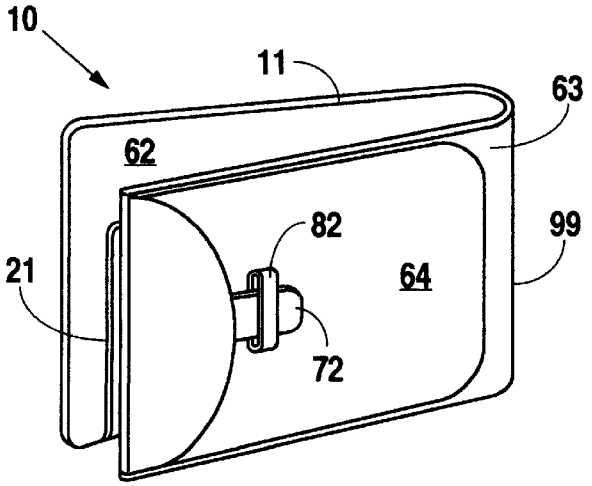
FIG. 9 illustrates a perspective view of an embodiment of the present invention in a single-fold position with an outer pocket on the rear side of the backing sheet.

Pockets 61 are attached to the inner surface 62 of the backing sheet 11 and are positioned or disposed between the cover flap 21 and the inner surface 62 of the backing sheet 11. It should be understood that one or more pockets 64 may be placed on the outer surface 63 of the billfold 10. FIG. 9 shows one such pocket on the outside of the backing sheet 11.

FIG. 4 further illustrates that the second cover flap 51 is similarly proportioned to first flap 21 as first flap 21 is to backing sheet 11. The length $L_2$ of the second flap 51 is more than one-half the full length $L_1$ of the first cover flap 21 but less than the full length $L_1$ of the first cover flap 21. In the same way the width $W_2$ of the second cover flap 51 is more than one-half the full $W_1$ of the cover flap 21, but less than the full length $W_1$ of the flap 21.

A preferable range of overlap of second flap 51 upon first flap 21 is in the range of 65%–85% in both directions. The figures are intended to illustrate an approximate 78% overlap in both directions.

FIG. 5 illustrates that an elongated top pocket 71 may be added along the outer surface 63 of backing sheet 11. Additionally, as illustrated in FIG. 6, pocket 81 may be provided with a transparent face 91 for viewing identification cards.

Figure 7:
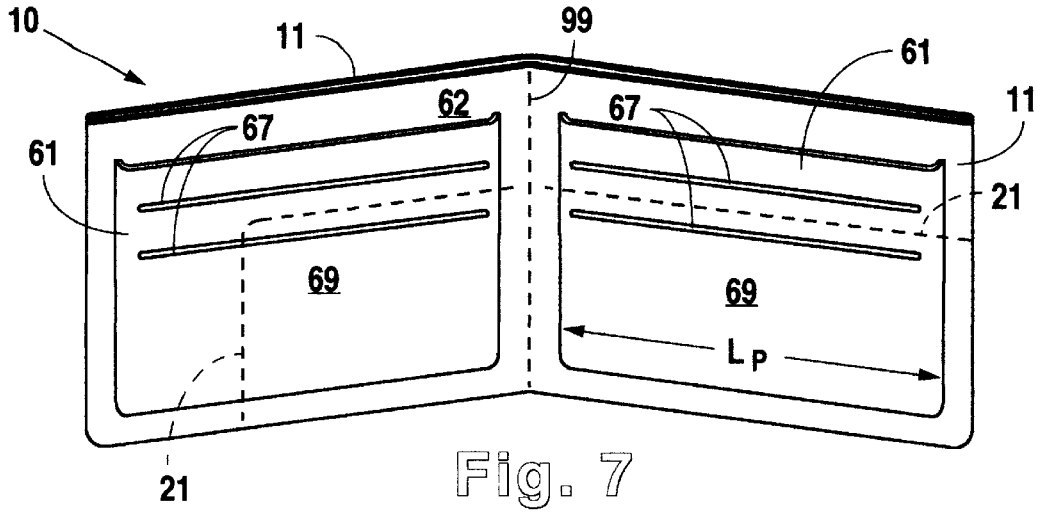
FIG. 7 is a perspective view of the backing sheet of the present invention with two inner pockets having transverse credit card slits; the first cover flap is shown in broken lines.
Figure 8:
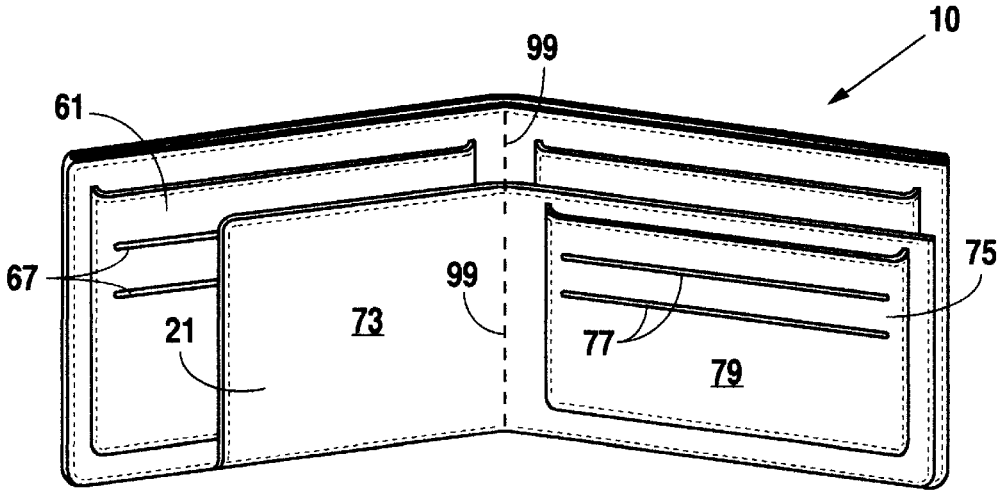
FIG. 8 is a perspective of the present invention with inner pockets and a pocket on the outer surface of the first cover flap.

Yet other embodiments of the present invention may be seen in FIGS. 7–9. In FIG. 7, a billfold 10 is shown with a backing sheet 11, but the cover flap 21 is shown in broken lines for clarity purposes. Two pockets 61 are affixed to the inner surface 62 of the backing sheet 11. The pockets are provided with transverse slits 67 for holding credit cards. The slits 67 extend substantially the full length LP of the pocket face 69.

FIG. 8 illustrates the embodiment of the present invention shown in FIG. 7, with the first cover flap 21 in position, A pocket 75 with transverse slits 77 is affixed to the outer face or surface 73 of the flap 21. The slits 77 extend transversely substantially the full length LP of the face 79 of the pocket 75.

FIG. 9 shows a billfold 10 in the single-fold, closed position with a pocket 64 on the outer surface 63 of the backing sheet 11. The pocket 64 is provided with a closure tab 72 which passes through clasp 82. Other well-known fasteners or closures may be used.

The overall design of this invention allows for the carrying of currency, credit cards and items in an ultra slim carrier or purse allowing the user to easily view the contents therein while shielding onlookers from seeing said contents.

Although the invention has been described with references to specific embodiments, this description is not meant to be construed in a limited sense. Various modifications of the disclosed embodiments, as well as alternative embodiments of the invention, will become apparent to persons skilled in the art upon the reference to the description of the invention. It is, therefore, contemplated that this disclosure and the attached drawings will cover such modifications that fall within the scope of the invention.

What is claimed is:

1. A single-fold billfold comprising:

a generally rectangular single sheet of backing material having four outer edges and a fixed length and width; and a first cover flap overlaying more than one-half said length and less than the full length of said backing sheet said cover flap only affixed to said backing material along a single outer edge of said length, said cover flap further overlaying more than one-half of said width and less than the full width of said backing sheet, said first cover flap aligned along a first and a second edge with a first outer and a second outer edge of said backing sheet.

2. The billfold of claim 1 further comprising at least one pocket attached to a surface of said backing material.

3. The billfold of claim 2 wherein said pocket is disposed between said backing sheet and said first cover flap.

4. The billfold of claim 2 wherein said pocket is disposed on a second surface of said backing sheet opposite a first surface of said sheet upon which said first cover flap overlaps.

5. The billfold of claim 2 wherein said pocket is disposed on a second surface of said first cover flap opposite a first surface of said first cover flap which lays against said backing sheet.

6. The billfold of claim 5 wherein said pocket further comprises a transparent face.

7. The billfold of claim 3 wherein a face of said pocket further comprises at least one transverse slit extending substantially a full length of said pocket face.

8. The billfold of claim 1 further comprising a second cover flap overlaying less than the full length and full width of said first cover flap, said second cover flap attached to said first cover flap and aligned along at least a first outer edge with said first edge of said first cover flap and said first outer edge of said backing sheet.

9. The billfold of claim 8 further comprising at least one pocket attached to a surface of said first cover flap.

10. The billfold of claim 9 wherein said pocket further comprises a transparent face.

11. The billfold of claim 9 further comprising a closure for said pocket.

12. A single-fold billfold comprising:

a generally rectangular single sheet of backing material having four outer edges and a fixed length and width;

a first cover flap and overlaying more than one-half said length and less than the full length of said backing sheet said cover flap only affixed to said backing material along a single outer edge of said length, said cover flap further overlaying more than one-half of said width and less than the full width of said backing sheet, said first cover flap aligned along a first and a second edge with a first outer and a second outer edge of said backing sheet;

at least one pocket attached to a surface of said backing material; and a second cover flap overlaying less than the full length and full width of said first cover flap, said second cover flap attached to said first cover flap and aligned along at least a first outer edge with said first edge of said first cover flap and said first outer edge of said backing sheet.

13. The billfold of claim 12 wherein said pocket is disposed on a second surface of said first cover flap opposite a first surface of said first cover flap which lays against said backing sheet.

14. The billfold of claim 13 wherein said pocket further comprises a transparent face.

15. The billfold of claim 12 wherein a face of said pocket further comprises at least one transverse slit extending substantially a full length of said pocket face.

16. The billfold of claim 12 wherein said pocket further comprises a transparent face.

17. The billfold of claim 12 further comprising a closure for said pocket.

* * * * *